United States Patent [19]

McEwen et al.

[11] 3,980,014

[45] Sept. 14, 1976

[54] BRIQUETTING MACHINE

[75] Inventors: Stephen N. McEwen; William S. LaFayette, both of Bowling Green, Ohio

[73] Assignee: Henry Manufacturing Company, Bowling Green, Ohio

[22] Filed: May 14, 1974

[21] Appl. No.: 469,859

[52] U.S. Cl. ..... 100/127; 100/DIG. 5; 100/112; 100/43

[51] Int. Cl.[2] ..... B30B 9/06

[58] Field of Search ..... 100/126–129, 100/104, 110, 251, 250, 249, 179, DIG. 5, DIG. 9, 43, 112, 188, 295

[56] References Cited

UNITED STATES PATENTS

| | | | |
|---|---|---|---|
| 100,142 | 2/1870 | Hartmann | 100/127 |
| 115,731 | 6/1871 | Hartman | 100/129 |
| 370,247 | 9/1887 | Cross | 100/127 |
| 695,990 | 3/1902 | Zoder | 100/129 X |
| 1,135,309 | 4/1915 | Meakin | 100/43 UX |
| 1,550,045 | 8/1925 | Power | 100/DIG. 8 |
| 2,422,895 | 6/1947 | Habenicht | 100/43 |
| 2,705,916 | 4/1955 | Millgard | 100/DIG. 5 |
| 3,550,775 | 12/1970 | Cooley | 100/112 |
| 3,863,559 | 2/1975 | Pierce | 100/127 |

*Primary Examiner*—Peter Feldman

*Attorney, Agent, or Firm*—Hugh A. Kirk

[57] ABSTRACT

A relatively thin briquetting chamber having a filter screen along at least one wall thereof, openable ends, a piston movable through said chamber from one end to the other to squeeze liquid from solid particles collected on the screen in said chamber and form a briquette, and an opening in the chamber for introducing the liquid and solid particles into the chamber. The chamber is so designed that no point inside the chamber is more than about three inches from a filter screen wall. This chamber may comprise a flat rectangular parallelepiped having openable ends, a bottom screen wall, a pair of side walls along the longitudinal edges of the bottom wall, and a top wall having an opening therein for introducing the liquid and solid particles, which if in the form of a sludge, this opening has to have a minimum dimension of at least six inches. The rectangular ends of this chamber, which usually have a width of at least twice that of their height, have an openable gate at one end thereof and a rectangular piston at the other end adjacent the opening in the top wall of the chamber. The separated liquid is collected outside the chamber and the openable gate permits discharge of the briquettes by the piston which forms them against the gate when closed. The piston and openable end may be operated mechanically by a crank, screw, or fluid cylinder; and pressure, limit, and/or timer switches may be provided for automatically initiating and controlling the briquette formation cycle.

18 Claims, 3 Drawing Figures

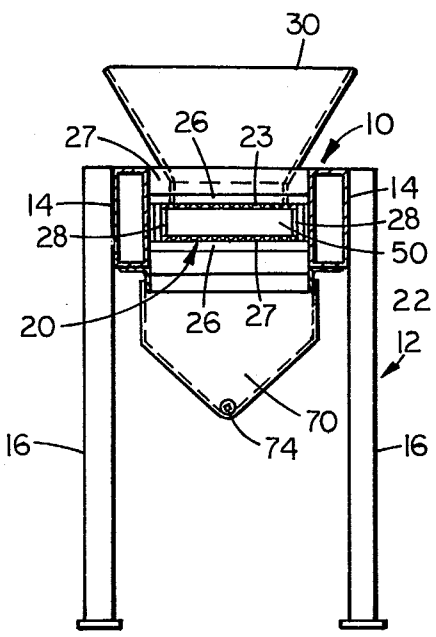
FIG. II
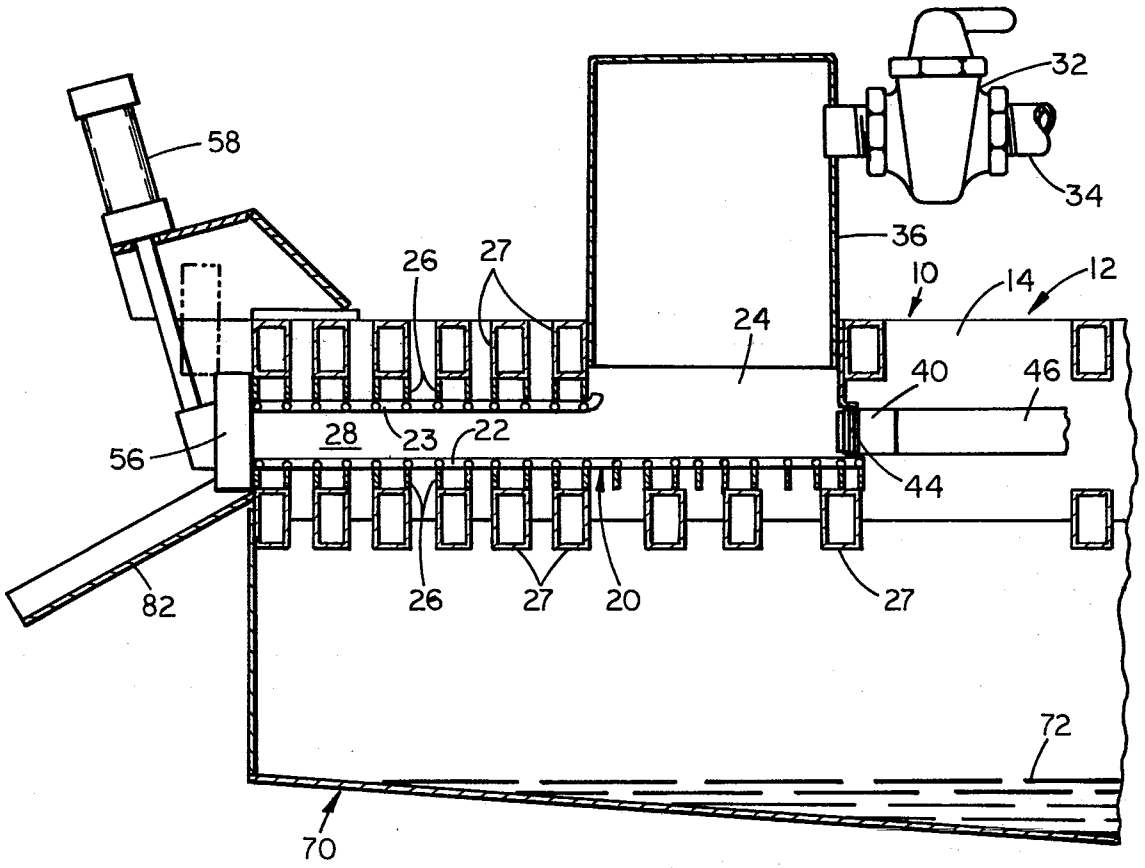
FIG. III

BRIQUETTING MACHINE

BACKGROUND OF THE INVENTION

Many different types of briquette forming or squeezing machines are known which employ a piston reciprocable in a perforated chamber, but most of these machines for large volumes and high pressures have a cylindrical configuration.

In view of scarcity of oil and the need to conserve it, and in view of the pollution problems in disposing of sludge containing substantial amounts of oil, such as sludges recovered from separators for coolants for cutting tools, it has become important that as much as possible of this type of oil be recovered from such sludges.

It has been found that to squeeze such sludges in previously known briquette forming machines, that the opening for the introduction of the sludge must have at least six inches minimum dimension, because of its tendency to bridge and block any narrower openings or ducts. Furthermore in order to economically squeeze large volumes of these sludges, a relatively large chamber is required. Then it was found, that if any particle in this chamber was more than about three inches, and preferably more than two inches from the filter screen in the chamber, only a minor amount of liquid or oil around such particle would penetrate the remaining compressed mass of particles to the screen and be removed. Thus, conventional briquetting chambers having a capacity for relatively large volumes of solids and producing pressures above about 250 psi, and preferably about 500 psi, were not sufficiently efficient to remove enough oil from such sludges to be practical.

SUMMARY OF THE INVENTION

Generally speaking, the briquetting machine of this invention comprises primarily a relatively thin compression chamber preferably of uniform cross-section between its ends which are openable, and has a filter screen at least along one side or wall thereof and an inlet opening preferably in another wall thereof. A piston is movable from one end through the chamber to the other end, to compress the particles into a briquette against a normally closed gate at the other end, which gate can be opened for discharge of the briquette by the piston. Any point within the chamber is not more than about three inches from a filter screen wall, and preferably between about 1 or 2 inches or less. Furthermore this chamber has such a volume and such a relatively large filter screen side, so that the filter screen can be used as a filter for a large volume of liquid containing solid particles passing through it, as well as for collecting sludges which may be dumped therein and require an opening into the chamber having a minimum dimension of at least 6 inches to prevent their bridging and clogging the opening. Thus, the thickness of the chamber is its smallest dimension, while the side containing the filter screen generally has its largest dimension.

Specifically, one embodiment of the chamber of this invention comprises a flat rectangular parallelepiped having one of its largest rectangular sides, such as its bottom, containing the filter screen, and its other parallel similar side comprising the top with the opening therein adjacent the end of the piston. One, two, or more of the sides or the walls of this chamber may be provided with a filter screen, which screen preferably comprises longitudinal slots, such as of the wedge wire type aligned longitudinally in the direction of the movement of the piston so as to be wiped by the edges thereof to reduce their clogging. These edges of the piston may be provided with gaskets, such as of polyurethane, to resist wear as much as possible. In order for the chamber to conform with the above mentioned requirements, the height thereof should not be more than about 3 inches, but if filter screens are provided on both the top and bottom sides thereof, it might may be as much about 6 inches. If the chamber is to receive sludge, and not liquid containing it, the opening in the chamber must have a minimum dimension of at least 6 inches, and if this opening is in the top wall or side of the chamber, then the width of the chamber will be at least 6 inches or twice that of the minimum height for one filter screen wall. Thus preferably the cross-sectioned area of the chamber is more than twice its height in order to provide as much volume in the chamber as possible, since the larger the volume the less often the briquetting cycle needs to be performed.

The liquid and solid particles to be separated and squeezed into a briquette may be either dumped into an open funnel over the open end of the top of the chamber, or this open end may be connected to a valved input duct so that the bottom wall of the chamber acts as a filter and when the pressure in this duct builds up due to the accumulation of solids on this filter, the compressing cycle can be started.

The apertured or filter screen walls of the chamber may be surrounded or enclosed for collecting the liquid drained and squeezed through their perforations, which collector usually includes a trough underneath the chamber from which the separated liquid may be recirculated into the system from which it was derived.

The movement of the elongated rectangular piston may be by a pair of piston rods, screws, or cranks powered electrically, hydraulically, or pneumatically. The gate or openable end of the chamber also may be similarly operated and may comprise a second piston opposing and aligned with the compressing piston, or it may be transversely operated like a sliding gate.

The control of the piston and gate may be manual and/or automatic through pressure, timer, and/or limit switches along the ducts and the paths of movements of said pistons or gates, for periodically cycling the forming and discharging of briquettes. In fact, if the compression of the solid particles does not take a predetermined time, the compressing piston may be retracted for the accumulation of more solids before completing the briquette, so that relatively uniform briquettes will be formed. Once this briquette is formed, timing means also may be provided for permitting the liquids squeezed therefrom to drain from the briquette before the gate end of the chamber is opened, and further pressure is applied to the compressing piston for pushing the briquette therefrom onto a conveyor or other chute leading from the chamber.

Objects and Advantages

Accordingly it is an object of this invention to produce an effective, efficient, economical, simple, strong, and precise briquetting machine comprising relatively flat filter screen surfaces which may be made of standard parts and which are reinforced to prevent bulging thereof under pressure, but still have sufficient area to accommodate relatively large volumes of liquid containing solid particles for compression under pressures greater than about 250 psi into briquettes, from which at least about 50% of the liquid around such particles can be squeezed therefrom and recovered.

Another object is to produce such a briquetting machine which can easily be repaired in case of wear of its parts and which avoids leakage around its compressing piston.

Another object is to produce such a briquetting machine which also acts as a filter, thereby permitting the reduction or elimination of a pre-separator for the liquid from the solid particles.

Still another object is to produce such a briquetting machine in which no particle in the briquette is more than about 3 inches and preferably less than 2 inches from a screen in the chamber in which it is formed, which chamber still is capable of handling relatively large volumes of sludge.

BRIEF DESCRIPTION OF THE VIEWS

The above mentioned and other features, objects and advantages, and a manner of obtaining them, are described more specifically below by reference to embodiments of this invention shown in the accompanying drawings, wherein:

FIG. I is a vertically sectioned side elevation of one embodiment of a briquetting machine according to this invention, in which liquid and solid particles are introduced into one end of the top of the compression chamber, and the gate at the other end of the chamber for discharge of the briquette comprises a piston;

FIG. II is a vertical section taken along lines II — II of FIG. I; and

FIG. III is an enlarged vertical section of another embodiment of a machine similar to that shown in FIG. I, in which the open top end of the compression chamber is connected to a valved input duct, the bottom screen wall of the compression chamber acts as a filter, and the gate at the end of the chamber operates transversely to that of the briquette compressing piston in the chamber.

DETAILED DESCRIPTION OF PREFERRED EMBODIMENTS

Figure 1:
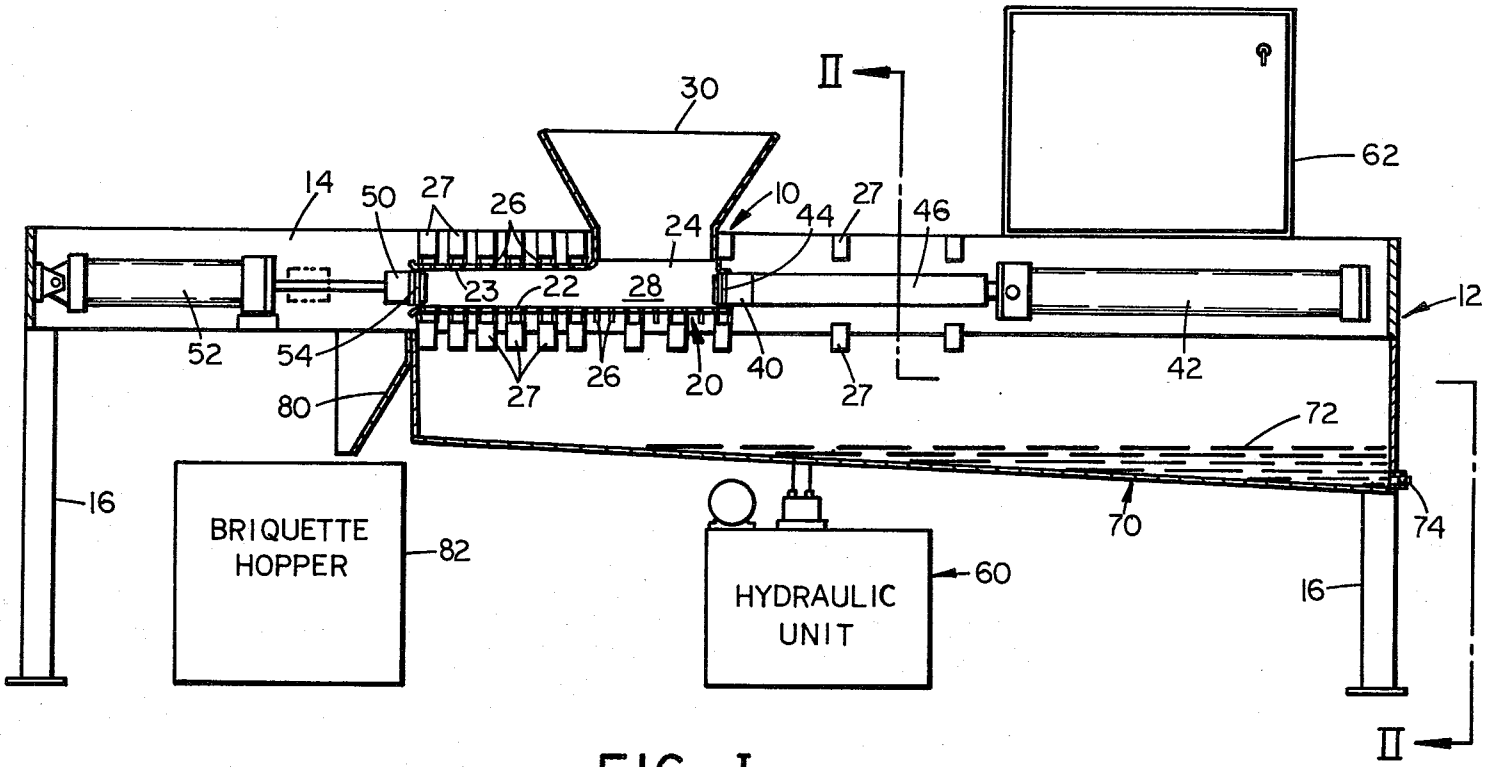

Referring first to the embodiment shown in FIGS. I and II, the briquetting machine 10 is shown mounted on a supporting frame 12 between a pair of parallel tubular girders 14 supported by legs 16, which also may have wheels or castors (not shown) for portability.

This machine 10 comprises essentially a rectangular compression chamber 20 fed through its top by a hopper 30, and having a compressing piston 40 for closing one end thereof, and a movable gate type piston 50 for closing the other end thereof. These pistons 40 and 50 may be operated by hydraulic cyclinders 42 and 52, respectively, under the control of an hydraulic unit 60 and its control panel or box 62. Below the chamber 20 and surrounding its perforated walls, there is provided a liquid collecting chamber 70 for collection of the liquid drained and squeezed out of the solid particles. This liquid 72 may be withdrawn through an outlet 74 near the bottom of this chamber 70 such as for recirculation and/or reuse. At the end of the chamber 20 at which the gate piston 50 is located, there may be provided a chute 80 for directing the briquettes discharged from the chamber into the hopper 82 when the gate 50 is retracted into dotted line position shown in FIG. I, and the briquette is pushed from this chamber by the full extension of the piston 40.

Referring now to the chamber 20, the elongated flat wedge wire filter screen bottom wall 22, has its slots extending longitudinally of this chamber so that they will be wiped longitudinally by the seal 44 around the rectangular edges of the piston 40.

The top wall 23 of the chamber 20 may also be made of wedge wire filter screen, or it may be a solid flat plate, as desired, and it covers at least half of the top of the chamber. The uncovered part or opening 24 in this top is adjacent the retracted piston 40, which opening 24 receives the outlet end of hopper 30 into which hopper 30 the liquid and solid particles, such as sludge and/or swarf are dumped or conveyed from a settling tank, or other solid separating apparatus.

These wedge wire filter screens are reinforced by a plurality of transversed parallel bars 26 which in turn are reinforced by heavier cross-bars 27 which may be welded or bolted together and to the flat plate sides 28 of the chamber and to the girders 14 of the frame 12 (see FIG. II).

This opened top end 24 of the chamber 20 is closed by the top portion 46 of the piston 40 when it starts compressing the solids which accumulate on the bottom screen 22, and this portion 46 continues to close this opening 24 throughout the full length of the compressing piston 40, thereby preventing additional solids and liquids from being introduced into the machine 10 during its briquetting cycle.

The normally closed end of the chamber 20 by the openable gate piston 50 may also be provided with a gasket 54, as the gasket 44 on the compressing piston 40, and this gate piston 50 may be retracted by the cylinder motor 52 after the briquette has been formed by the extension of the piston 40 to adjacent the piston 50. Then further movement of the piston 40 will discharge the compressed briquette out the now open end of the chamber, onto the chute 80 to slide into the hopper 82. After this the gate piston 50 returns to its full line position shown in FIG. I while the compressing piston 40 retracts to its full line position shown in FIG. I ready for the start of the next briquetting cycle, after sufficient particles have accumulated on the filter screen 22.

Limit switches (not shown) may be provided along both pistons 40 and 50 for controlling their operation through the control panel 62, which also may include timers for delaying the action at different stages, such as for example if the piston 40 reaches a given limit switch before particular period of time, then sufficient particles have not accumulated on the filter bottom 22 of the chamber 20 to form a briquette, the piston 40 will retract for another period of time until more particles can accumulate on this bottom 22. Once the briquette has been formed near the end of the chamber adjacent the piston 50, the retraction of the piston 50 may be delayed a certain time to permit the liquid squeezed out of the particles to drain therefrom through the filter screen walls of the chamber 20 before the pressure on the briquette is released. Of course, the cycling operation of this device may be manually controlled, if desired.

Referring now to FIG. III, there is shown an apparatus similar to that shown in FIGS. I and II, but instead of having a hopper 30 there is provided a valve 32 in a duct 34 connected by an enclosure 36 over and to the opening 24 of the chamber 20, for the introduction of liquid containing solid particles directly into the chamber 20. In this embodiment the bottom chamber wall 22 acts to filter out the solid particles and build-up a bed of sludge, which, when the back pressure gets so great in the input line 34, the briquetting cycle will automatically start by first shutting the valve 32. Furthermore, this embodiment in FIG. III shows, instead of having a gate piston 50 at the normally closed end of the chamber 20, a transversely operated gate 56 which may be operated by hydraulic motor 58, as is the cylinder motor 52 in FIG. I.

It is to be understood that other means for operating the pistons 40 and gates 50 or 56 instead of hydraulic motors may be employed, such as screws, pneumatic motors, cranks and levers, etc. without departing from the scope of this invention. Furthermore the gate 56 may replace the piston 50 in the embodiment shown in FIG. I, and/or the duct means 32, 34, and 36 may replace the hopper 30 as shown in FIG. I, without departing from the scope of this invention.

Although the compressing chamber 20 is shown to be relatively horizontal, if top wall 23 thereof also comprises a filter screen, then it may be advantageous to tilt the chamber 20 so that the liquid squeezed through the screen in the top wall may more readily run off into the collector 70, and not repenetrate the briquette once the pressure thereon is released before it is discharged through the openable end or gate 50 or 56. Thus this chamber 20 may be mounted even vertically, if desired, without departing from the principles of this invention.

While there is described above the principles of this invention in connection with specific apparatus, it is to be clearly understood that this description is made only by example and not as a limitation to the scope of this invention.

I claim:

1. A briquetting machine for removing liquid from liquid and solid particles comprising:

A. a compression chamber capable of withstanding at least about 250 p.s.i. and having openable ends and at least two parallel side walls between said ends, at least one of which walls has therein parallel outwardly diverging filter slots extending longitudinally between said ends, which slots are less than about three inches from any point inside said chamber, and said chamber has an opening therein having a minimum dimension of about six inches for receiving said liquid and solid particles, B. an openable means for closing and sealing off one end of said chamber during compression, C. a piston means closing and sealing off the other end of said chamber and relatively movable the full length of said chamber between said ends, said piston having a gasket surrounding its edge for wiping the inside walls of said chamber, and D. means for introducing said liquid and solid particles into said opening in said chamber.

2. A machine according to claim 1 wherein said chamber has a substantially uniform cross-section between said ends.

3. A machine according to claim 1 wherein said slots are less than about two inches from any point inside said chamber.

4. A machine according to claim 1 wherein said slots are less than about 1 inch from any point inside said chamber.

5. A machine according to claim 1 including means for operating said piston means.

6. A machine according to claim 5 wherein said means for operating said piston means comprises an hydraulic motor.

7. A machine according to claim 1 including means for operating said openable means.

8. A machine according to claim 1 wherein the walls of said chamber are reinforced by bar means.

9. A machine according to claim 1 wherein said openable means comprises a piston aligned with and opposite said piston means closing the other end of said chamber.

10. A machine according to claim 1 wherein said openable means comprises a transversely operated gate means.

11. A machine according to claim 1 wherein said means for introducing liquid containing particles comprises a hopper over said opening in said chamber.

12. A machine according to claim 1 wherein said piston means comprises a plate for closing said opening in said chamber.

13. A machine according to claim 1 including means surrounding said filter slots for collecting the liquid that passes through said slots.

14. A machine according to claim 1 wherein said means for introducing said liquid and solid particles comprises a valved duct connected to said opening in said chamber.

15. A machine according to claim 1 including chute means adjacent said one end of said chamber for receiving briquettes discharged from said chamber.

16. A machine according to claim 1 wherein said chamber comprises a rectangular parallelepiped.

17. A machine according to claim 16 wherein said wall containing said filter slots is one of the largest walls of said chamber.

18. A machine according to claim 17 wherein said opening is in the opposite wall parallel to said one largest wall of said chamber and is adjacent said piston means.

* * * * *